United States Patent [19]

Llewellyn

[11] Patent Number: 4,508,339

[45] Date of Patent: Apr. 2, 1985

[54] EYE-HAND COORDINATOR

[75] Inventor: Link W. Llewellyn, Flint, Mich.

[73] Assignee: Chi Rho Corporation, Flint, Mich.

[21] Appl. No.: 615,165

[22] Filed: May 30, 1984

[51] Int. Cl.[3] ..... A63B 69/40

[52] U.S. Cl. ..... 273/26 E; 273/29 A; 273/200 B; 273/197 R

[58] Field of Search ..... 273/26 R, 29 A, 35 R, 273/184 R, 184 B, 185 D, 197 A, 200 B, 26 E, 197 R

[56] References Cited

U.S. PATENT DOCUMENTS

| | | | |
|---|---|---|---|
| 2,818,255 | 12/1957 | Ponza | 273/26 E |
| 3,876,203 | 4/1975 | Gold | 273/29 A |
| 3,924,853 | 12/1975 | Schleeger | 273/29 A |
| 4,042,237 | 8/1977 | Moraru | 273/29 A |
| 4,105,203 | 8/1978 | Cho | 273/29 A |
| 4,175,744 | 11/1979 | Llewellyn | 273/200 B |
| 4,407,503 | 10/1983 | Nishizawa | 273/197 R |
| 4,460,172 | 7/1984 | Hogan | 273/29 A |

FOREIGN PATENT DOCUMENTS

| | | | |
|---|---|---|---|
| 706628 | 6/1931 | France | 273/197 |
| 370590 | 4/1932 | United Kingdom | 273/29 A |

*Primary Examiner*—Richard C. Pinkham
*Assistant Examiner*—T. Brown
*Attorney, Agent, or Firm*—Harold W. Milton, Jr.

[57] ABSTRACT

An eye-hand coordinator assembly (10) includes support members (12) having a longitudinal axis and a ball supporting arm (14) having a ball (16) disposed at a distal end (18) thereof. A cam member (20, 30) operatively supports the ball supporting arm (14) on the support member (12) and allows the arm (14) and the ball (16) to be displaceable from an initial rest position angularly about the longitudinal axis in response to an impact of the ball (16) while axially shifting along the longitudinal axis. The assembly (10) is characterized by the utilization of a spring (22) to dissipate the energy imparted to the arm (14) upon impact of the ball (16) after a predetermined amount of free movement of the arm (14) from the initial rest position. The spring (22) has a length shorter than the axial distance between the cam member (30) and a stop (24) when the assembly is in the initial rest position. The spring (22) is engageable with the stop (24) for compression thereof after the predetermined amount of free movement of the arm (14) whereupon the compressed spring (22) reacts with the stop (24) to return the ball support arm (14) and the ball (16) to the initial rest position. A roller (38, 54) is engageable with a symmetrical cam surface (32) allowing axial displacement of the cam member (30) and arm (14) during use by both left-handed and right-handed batters.

13 Claims, 7 Drawing Figures

EYE-HAND COORDINATOR

TECHNICAL FIELD

The subject invention relates to an eye-hand coordinator or batting practice device of the type having a returnable arm supporting a ball which may be struck. These devices are used to provide exercise, improving bodily movements for sports wherein an object or ball is to be struck, increasing strength, developing eye-hand coordination, therapy and special education classes, etc. These devices are used indoors and outdoors by children and adults, therefore, it is desirable that these devices be adjustable, durable and portable, yet stable.

BACKGROUND OF INVENTION

Typical of a batting practice device or an eye-hand coordinator assembly of the type to which the instant invention pertains is that shown in my U.S. Pat. No. 4,175,744 granted Nov. 27, 1979. In that patent a cam mechanism operatively connects one end of a ball-supporting arm to a standard allowing the arm and a ball to be displaceable from an initial position in response to an impact ball. My prior invention also employs resilient means in the form of an elastic strap on the outside of the standard which interconnects an upper cam and a lower cam to provide a vertical adjustment and ball return mechanism.

U.S. Pat. No. 2,818,255, granted Dec. 31, 1957 to L. J. Ponza and cited in my prior patent discloses a connecting rod capable of limiting rotation and axial shifting of an upper cam coacting with a roller pin by connection of the rod to a spring which has a fixed position inside of a standard.

U.S. Pat. No. 3,341,200, granted Sept. 12, 1967 to E. W. Brandley, discloses a ball-supporting arm which is connected to a coupling which is adjustably mounted on a standard.

Additionally, none of the prior art patents discussed above suggest a manner of dissipating the energy imparted to the ball support arm upon impact of the ball after a predetermined amount of free movement of the arm following such impact.

STATEMENT OF INVENTION AND ADVANTAGES

According to the present invention, there is provided an eye-hand coordinator assembly comprising support means having a longitudinal axis, a ball-supporting arm having a ball disposed at a distal end thereof and cam means operatively supporting the ball-supporting arm on the support means for allowing the arm and the ball to be displaceable from an initial rest position angularly about the longitudinal axis in response to an impact of the ball while axially shifting along the longitudinal axis. The assembly is characterized by energy dissipation means for dissipating the energy imparted to the arm upon impact of the ball after a predetermined amount of free movement of the arm from the initial rest position.

Although the prior art devices included motion limiting and/or ball return mechanisms, the means employed, such as the elastic strap in my prior U.S. Pat. No. 4,175,744, resulted in immediate dissipation of the energy imparted to the arm upon impact of the ball. Such immediate and continuous resistance to the angular displacement of the ball support arm following impact of the ball does not adequately simulate actual playing conditions where there is no initial resistance to impact of the ball other than the momentum of the ball. Accordingly, the subject invention provides energy dissipation means, in the form of a coil spring coiled about the longitudinal axis of the support means and with a length shorter than the axial distance between the cam means and stop means when the assembly is in an initial rest position. The spring means is engageable with the stop means for compression thereof between the stop means and cam means after a predetermined amount of free movement of the arm and ball. The spring does not compress until the bat has lost contact with the ball, thus allowing follow through of the bat more readily than a device having initial tension. This property is maintained even though the stop means may be adjusted within its operable range to vary the degree of resistance to 360° rotation of the arm by adjusting the gap between spring and stop means.

BRIEF DESCRIPTION OF THE DRAWINGS

Other advantages of the present invention will be readily appreciated as the same becomes better understood by reference to the following detailed description when considered in connection with the accompanying drawings wherein.

DETAILED DESCRIPTION OF THE DRAWINGS

Figure 1:
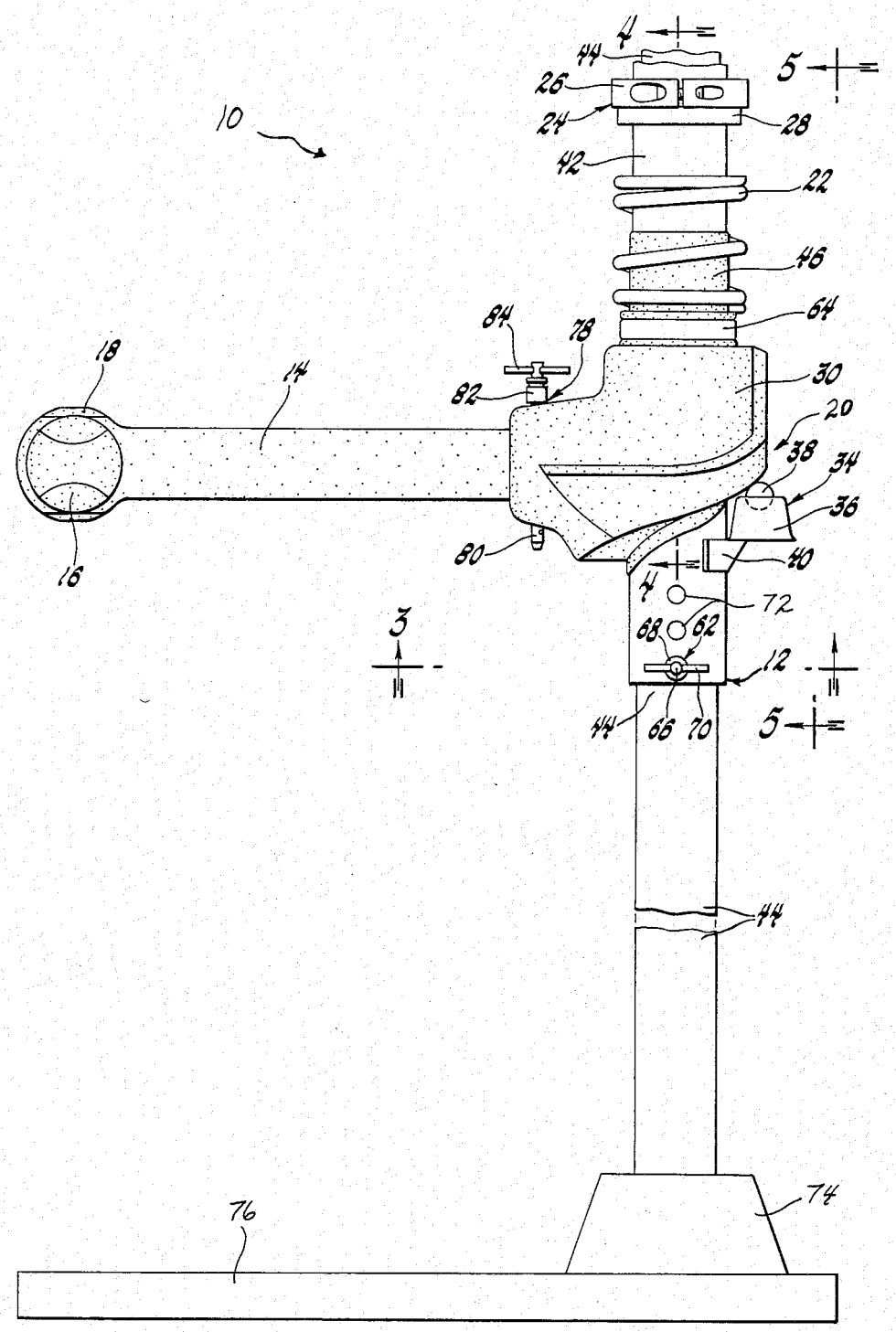
FIG. 1 is an external view of the eye-hand coordinator assembly of the subject invention shown in the initial rest position.
Figure 2:
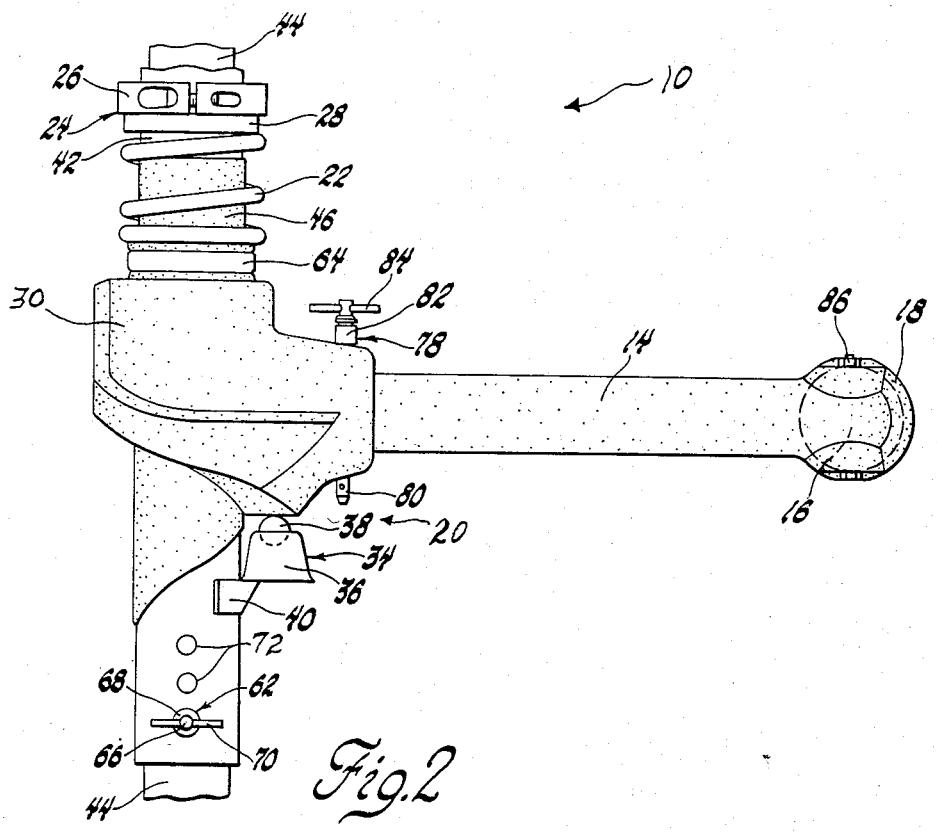
FIG. 2 is an external view of the eye-hand coordinator assembly of the subject invention shown with the ball support arm in an angularly displaced and axially shifted position.

An eye-hand coordinator assembly constructed in accordance with the subject invention is generally shown at 10 in FIG. 1. A support means, generally indicated at 12, has a longitudinal axis and a ball-supporting arm 14 extending therefrom with a ball 16 disposed at the distal end 18 of the arm 14. Cam means, generally indicated at 20, operatively supports the ball-supporting arm 14 on the support means 12 and allows the arm 14 and the ball 16 to be displaceable from an initial rest position (FIG. 1) angularly about the longitudinal axis in response to an impact of the ball 16 while axially shifting along the longitudinal axis. The ball-supporting arm 14 is shown in an angularly displaced and axially shifted position in FIG. 2.

The assembly 10 is characterized by energy dissipation means for dissipating the energy imparted to the arm 14 upon impact of the ball 16 after a predetermined amount of free movement of the arm 14 from the initial rest position shown in FIG. 1. The energy dissipation means includes spring means comprising a coil spring 22 coiled about the longitudinal axis of the support means 12 and reaction means 24 for reacting with the spring means after a predetermined amount of free movement of the arm 14 so that reaction thereof with the spring means 22 causes the spring means 22 to dissipate the energy imparted to the ball 16 and arm 14. The reaction means comprises stop means, generally indicated at 24, disposed on the support means 12 and in axially spaced relationship to the cam means 20. The coil spring 22 situated between the cam 20 and stop 24 means, has a length shorter than the axial distance between the cam means 20 and the stop means 24 when the assembly is in an initial rest position (FIG. 1) and is engageable with the stop means 24 for compression thereof after a predetermined amount of free movement of the arm 14.

The stop means 24 comprises a clamp 26 removably clamped to the support means 12 and a thrust bearing 28 supported by the clamp 26 for engaging the spring 22. An additional thrust bearing 64 is shown although either one of the bearings 28, 64 may be dispensed with. The stop means 24 is axially adjustable along the longitudinal axis of the support means 12 for selectively varying the predetermined amount of free movement of the arm 14 before the spring 22 engages the stop means 24 to begin the dissipation of energy by compression of the coil spring 22. The degree of energy dissipation varies with adjustment of the stop means which adjusts the resistance to 360° rotation of the arm.

The cam means 20 comprises a cam member 30 disposed about the support means 12 for rotation about and axial movement along the longitudinal axis thereof. The cam means 20 presents a symmetrical cam surface 32 and includes roller means, generally indicated at 34, supported by the support means 12 in rolling engagement with the cam surface 32 to cause axial movement of the cam member 30 along the longitudinal axis of the support means 12 upon rotation of the cam member 30 thereabout.

The roller means 34 preferably comprises a ball retainer 36 attached to the support means 12 by a mount 40 and a spherical ball 38 retained in the retainer 36 and in rolling engagement with the cam surface 32.

The support means 12 comprises a first or outer tube 42 of circular cross section supporting the mount 40, retainer 36, and stop means 24, and having the spring 22 and cam member 30 disposed thereabout. A support post 44 extends into the first tube 42 and supports the same. A friction-resistant protective sleeve or sheath 46 surrounds a portion of the length of the tube 42, extending from a point on the tube 42 adjacent the coil spring 22 and dove-tailing to a point adjacent the roller means 34 in order to accommodate the geometry thereof. The sheath 46 provides a low frictional surface covering the outer tube 42 during the compression and release of the spring 22 due to the angular displacement and axial shifting of the arm 14 following impact of the ball 16. In addition to resisting abrasion of the spring 22 and tube 42, the sheath 46 covers the outer surface of the tube 42 at the operative connection of the cam member 30 effecting the frictional contact therebetween.

A support post 44 of circular cross section is shown in FIGS. 1–5. In FIGS. 6 and 7 the support post 48 has a square cross section for mating and sliding engagement with a second tube 50 of substantially square cross section secured within the first tube 42 by welds 52 (FIG. 7). The tube 50 need not be of square cross section along its entire length, rather, only near the adjustment means 62 is it necessary for tube 50 to be square to minimize wear on the pin 66 by providing a secure fitting engagement between the tube 50 and post 48 at the location of the pin 66.

With reference to FIGS. 6 and 7, the roller means 34 alternatively takes the form of a wheel 54 connected by a bolt 56 to the support means 12 and held by a washer and thrust bearing assembly 58 in spaced relationship to the cam surface 32. The bolt 56 is fastened to the support means 12 at a raised aperture 60. In the embodiments of FIGS. 1 through 5 the roller means 34 described above is replaceably or removably connected to the support means 12 by mount 40.

Referring again to FIGS. 1 through 5, adjustment means, generally indicated at 62, interconnects the support post 44 and the first tube 42 and adjusts the position of the tube 42 axially along the support post 44. The adjustment means 62 comprises a pin 66 having a head 68 and handle 70 for removal and insertion in either of the apertures 72 in the first tube 42 which are in registration with like apertures in the support post 44. This adjustment varies the height of the arm in the initial rest position to accommodate different batters.

Figure 3:
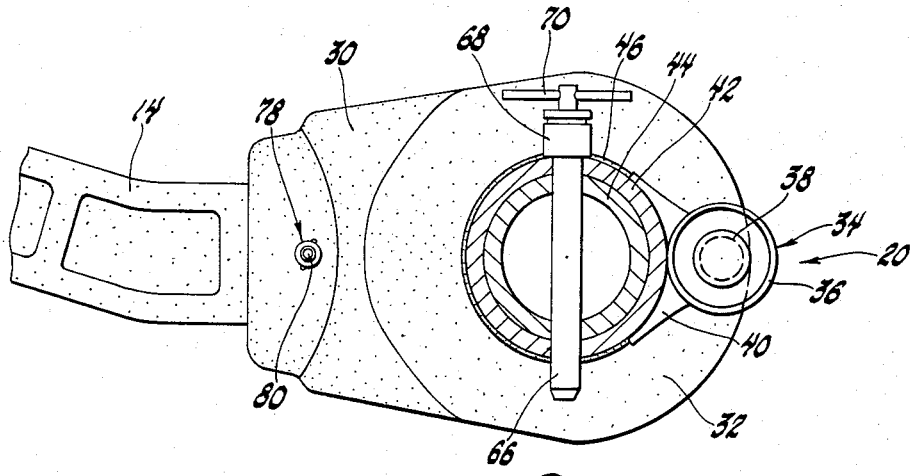
FIG. 3 is a bottom plan view of the eye-hand coordinator assembly of the subject invention.
Figure 4:
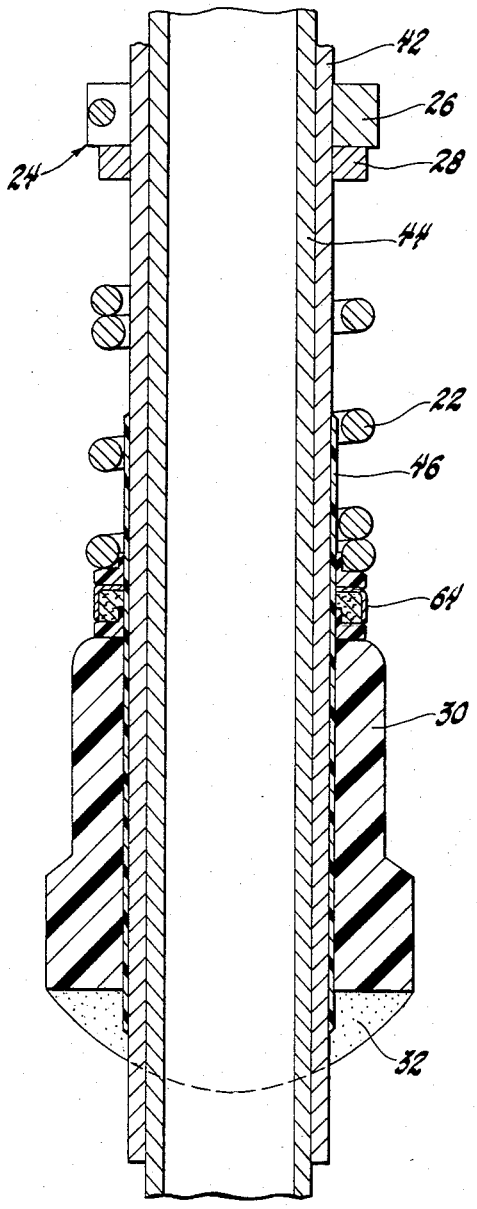
FIG. 4 is a cross-sectional view taken substantially along the lines 5—5.

The wheel 54 (FIGS. 6 and 7) and cam surface 32 of the cam member 30 are preferably of hard material, e.g., plastic or metal, which may be similar or different, to provide a more optimal bearing surface therebetween. The cam member is of durable material, preferably (though not essential) molded in one piece and surrounding the tube 42 for rotation thereabout and axial movement therealong. The ball 38 and retainer 36 in FIGS. 1 through 5 are preferably of metal. The support post 44 can be made to extend into a standard 74 incorporated in a suitable platform support structure 76. The assembly 10 may be used by either right-handed or left-handed batters and for this purpose there is provided connection means, generally indicated at 78, removably connecting the arm 14 to the cam member 30 for reversing the operative position of the arm 14. The connection means 78 further includes a pin 80 having a head 82 and handle 84 similar to that of the pin 66. As can be seen in FIG. 3, the arm 14 includes an angular bend or curve orienting the arm 14 for either a right-handed or left-handed batter. It should be understood that the subject assembly is capable of being fitted with a variety of objects other than the ball 16 to be struck, depending upon the particular sport for which the user is training. For this purpose, the ball 16 is of a durable material, e.g., molded urethane, rubber or other plastic, and structured to fit within a suitable socket (not shown) at the end 18 of the arm 14. The unitary structure of the ball 16 or other object comprises a spherical portion to be struck and a standard integral elongated portion for insertion into a socket at the end 18 of the arm 14. A pin 86 is inserted into a suitable aperture provided in the end 18 and through a mating aperture in the elongated portion of the ball within the socket. In this manner, the ball 16 is removably or replaceably secured in the socket of the end 18 by the pin 86; of course, any other object or ball could be struck by fitting and insertion within the socket in the same manner.

Figure 5:
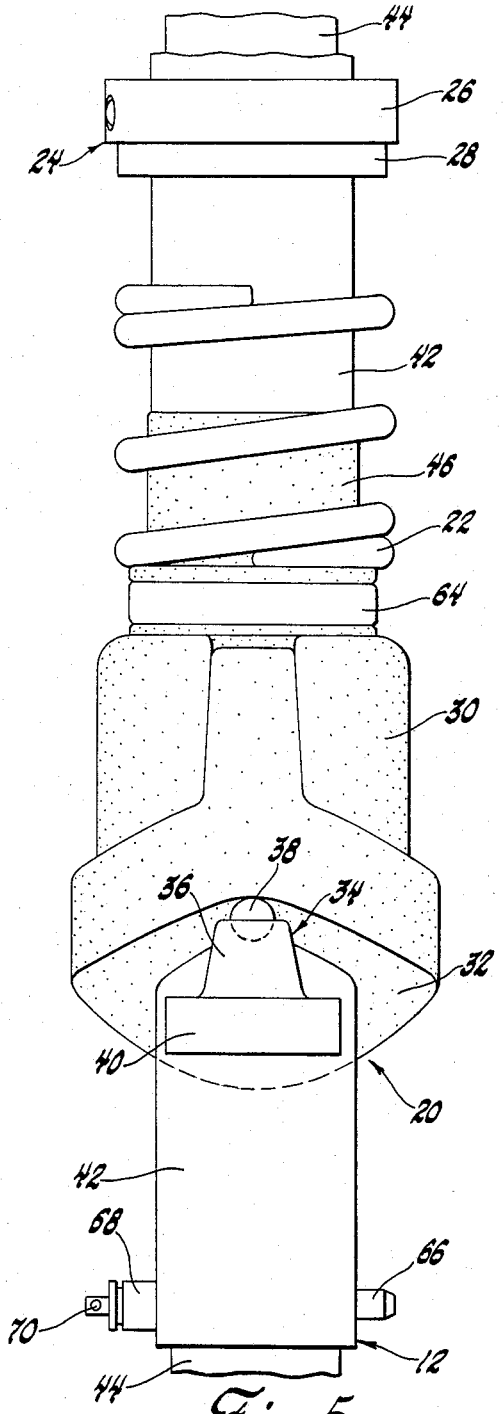
FIG. 5 is an external back view taken substanitally along the axis of the ball support arm in the initial rest position.
Figure 6:
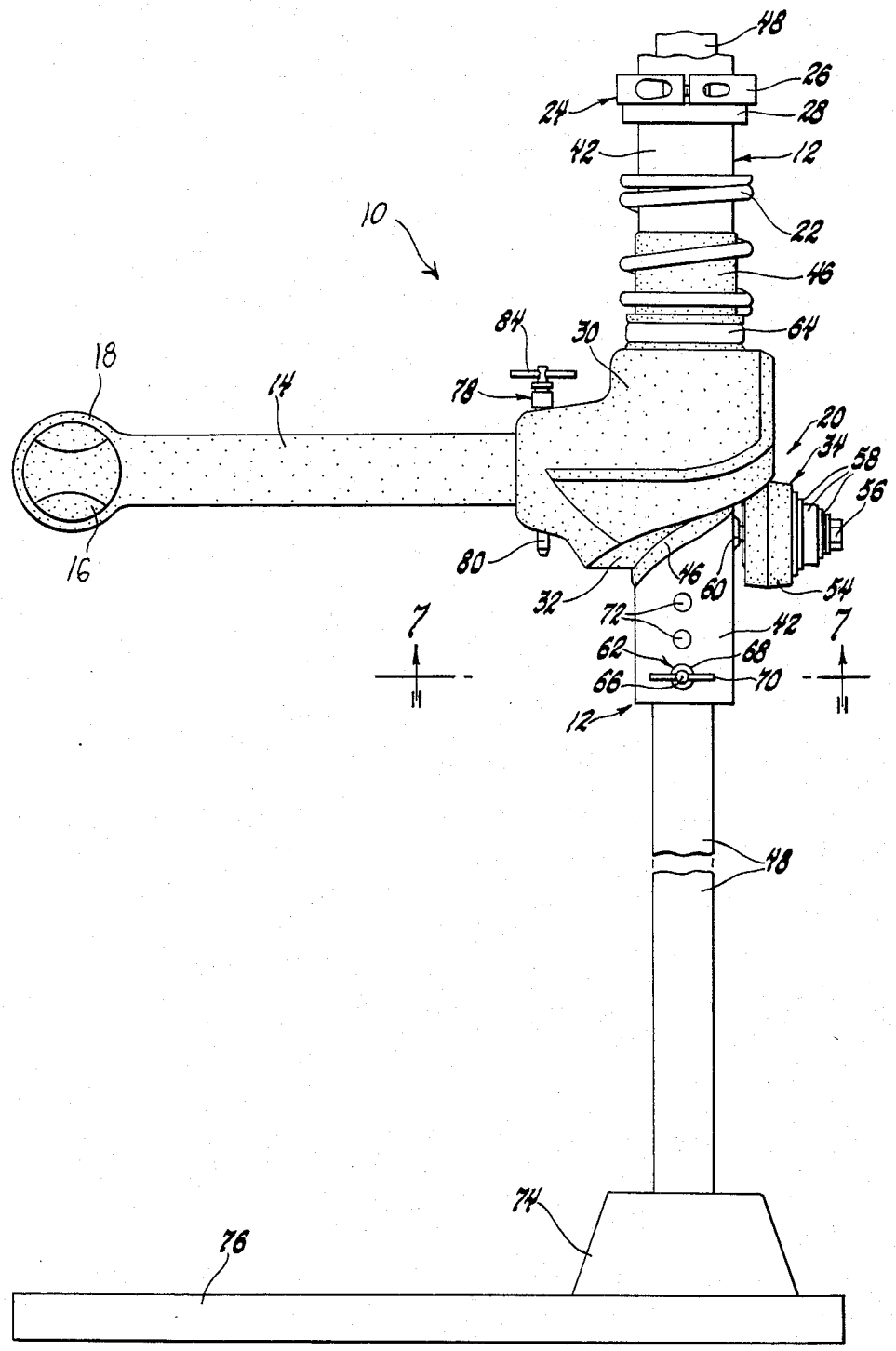
FIG. 6 is an external view of an alternative embodiment of the eye-hand coordinator of the subject invention shown in the initial rest position.
Figure 7:
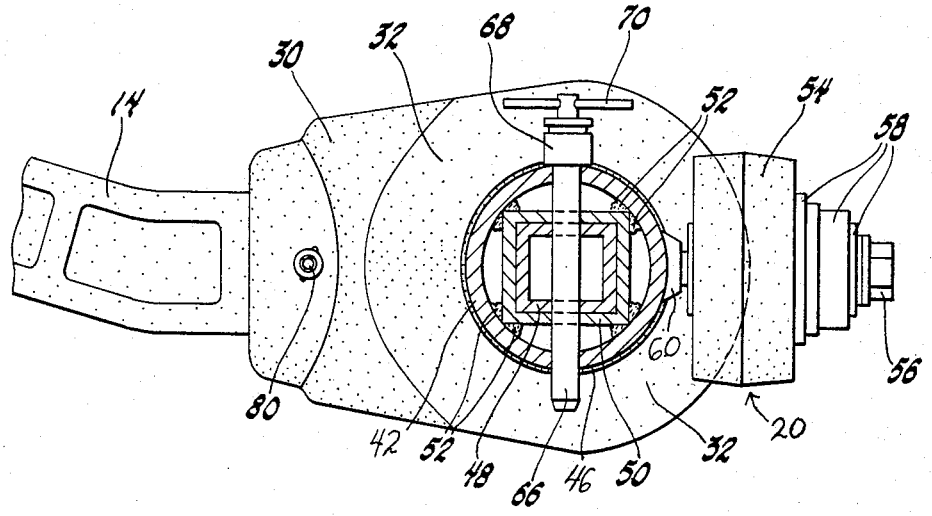
FIG. 7 is a cross-sectional view taken substantially along the lines 7—7 of FIG. 6.

It should be appreciated that the cam surface 32 is symmetrical about its contact with the ball (or roller) while in the initial rest position (FIGS. 1, 5 and 6). Thus, axial shifting of the arm 14 in response to rotation of the arm 14 about the longitudinal axis of the support means 12 takes place in either direction from the initial rest position. This symmetry is clearly seen in FIG. 5, making it possible for both left and right-handed batters to use the device.

In operation, the first tube 42 is slidably adjusted on the support post 44 (FIGS. 1–5) to the desired height and the pin 66 is inserted into the desired aperture 72 to interconnect the post 44 and tube 42, fixing the position of the tube 42 along the post 44. In the initial rest position the cam member 30 surrounds the tube 42 presenting a symmetrical cam surface 32 extending from a valley about the tube 42 to a crest 180° from the valley. When the ball 16 is struck by a bat there is no initial resistance to the momentum of the bat other than the inertia of the rotating members and ball, thus approaching the actual feel of a batter striking a pitched ball. Impact to the ball causes the arm to be both angularly displaced and axially shifted due to the operative cam connection of the arm 14 to the support means. More specifically, angular displacement of the arm either clockwise or counterclockwise about the axis brings the ball 38 into engagement with the crest of the cam surface 32 causing the cam member 30 to be axially shifted upward in the direction of the stop means 24. The ball 38 dissipates both the downward (toward the ground) and the lateral (parallel to the ground) components of force being exerted on the ball 38 due to the combined displacements of the cam member 30. In this regard, the thrust bearing assembly 58 dissipates the lateral force thereon. Consequently, the spring 22 is compressed as the distance between the cam member 30 and the stop means 24 is sufficiently shortened. When the assembly 10 is in an initial rest position (FIGS. 1, 5 and 6) as set forth above, the distance between the cam member 30 and the stop means 24 is greater than the length of the spring 22 so that compression of the spring 22 does not occur until the cam member 20 has been axially shifted sufficiently to cause the gap between the spring 22 and the stop means 24 to close and compress the spring 22. This gap between the spring and stop means predetermines the amount of free movement of the arm prior to compression of the spring and reaction thereof to return the ball to the initial rest position. The total amount of predetermined free movement of the arm may be varied by adjusting the position of the clamp axially along the axis of the support means, which simultaneously varies the degree of resistance to 360° rotation of the arm as will be presently described.

Complete 360° rotation of the arm about the axis of the support means indicates a good hit by the batter in terms of both force and accuracy, thus positively rewarding the batter. It will be appreciated by those skilled in the art that adjustment of the stop means varies the degree of resistance to this 360° rotation while leaving the initial amount of free movement of the arm unaffected when the ball is struck, allowing an uninterrupted follow-through until the bat has left the ball.

The subject invention is especially desirable and unique in that it encourages a level or slightly downward swing of the bat, which is the preferred baseball swing. This is due to a slight shimming action of cam member 30 during its displacement along the longitudinal axis of the support means. This shimming action does not occur when the ball is struck using a level or slightly downward force; such a force serves to effectively "help" the cam member and arm around the longitudinal axis with minimal dissipation of energy via the shimming action. On the other hand, an upward swing, i.e., an upward force on the ball, causes shimming at the operative connection of the cam member to the support means, discouraging the complete rotation of the cam member and arm. Thus, an upward swing negatively rewards the batter.

As described above, the initial free movement of the arm allows a more natural and uninterrupted follow-through since the spring does not compress until the bat has fully left the ball. In addition, this feature of the invention contributes to the longevity of the device. In particular, the arm is relieved since the force thereon is more rapidly translated to axial motion on the cam member.

The assembly may be adjusted to accommodate both right and left-handed batters of various heights, moreover it provides the batter with an opportunity to practice hitting pitches in various portions of the strike zone.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims wherein reference numerals are merely for conveience and are not to be in any way limiting, the invention may be practiced otherwise than as specifically described.

The embodiments of the invention in which an exclusive property or privilege is claimed are defined as follows:

1. An eye-hand coordinator assembly (10) comprising; support means (12) having a longitudinal axis, a ball-supporting arm (14) having a ball (16) disposed at a distal end (18) thereof, cam means (20) operatively supporting said ball-supporting arm (14) on said support means (12) for allowing said arm (14) and said ball (16) to be displaceable from an initial rest position angularly about said longitudinal axis in response to an impact of said ball (16) while axially shifting along said longitudinal axis, said assembly characterized by energy dissipation means (20, 22, 24) for dissipating the energy imparted to said arm (14) upon impact of said ball (16) after a predetermined amount of free movement of said arm (14) from said initial rest position.

2. An assembly as set forth in claim 1 further characterized by said energy dissipation means including spring means (22) having a free state when said arm (14) is in said initial rest position and reaction means (24) for reacting with said spring means (22) after said predetermined amount of free movement of said arm (14) so that the reaction with said spring means (22) causes said spring means (22) to dissipate the energy.

3. An assembly as set forth in claim 2 further characterized by said reaction means comprising stop means (24) disposed on said support means (12) in axially spaced relationship to said cam means (20) and said spring means comprises a coil spring (22) coiled about the axis of said support means (12) with a length shorter than the axial distance between said cam means (20) and said stop means (24) when said assembly (10) is in said initial rest position and engageable with said stop means (24) for compression thereof after said predetermined amount of free movement of said arm (14).

4. An assembly as set forth in claim 3 further characterized by said stop means (24) being axially adjustable along said axis for selectively varying said predetermined amount of free movement of said arm (14) before said spring (22) engages said stop means (24) to begin said dissipation of energy by compression of said coil spring (22).

5. An assembly as set forth in claim 4 further characterized by said stop means (24) comprising a clamp (26) removably clamped to said support means (12) and a thrust bearing (28) supported by said clamp (26) for engaging said spring (22).

6. An assembly as set forth in claim 3 further characterized by said cam means (20) comprising a cam member (30) disposed about said support means (12) for rotation about and axial shift along said longitudinal axis thereof and presenting a cam surface (32) and a roller means (34) supported by said support means (12) in rolling engagement with said cam surface (32) to cause axial shifting of said cam member (30) upon rotation thereof about said longitudinal axis of said support means (12).

7. An assembly as set forth in claim 6 further characterized by said roller means (34) comprising a ball retainer (36) attached to said support means (12) and a spherical ball (38) retained in said retainer (36) and in rolling engagement with said cam surface (32).

8. An assembly as set forth in claim 7 further characterized by said support means (12) comprising a first tube (42) of circular cross section supporting said retainer (36) and said stop means (24) and having said spring (22) and said cam member (30) disposed thereabout, and a support post (44) extending into said first tube (42) and supporting same.

9. An assembly as set forth in claim 8 further characterized by said support means further including a second tube (50) of square cross section secured within said first tube (42), said support post (48) having a square cross section for mating and sliding engagement within said second tube (50).

10. An assembly as set forth in claim 9 further characterized by including adjustment means (62) interconnecting said support post (44, 48) and one of said first (42) and second (50) tubes for adjusting the initial rest position of said arm (14) axially along said support post (44, 48).

11. An assembly as set forth in claim 8 further characterized by said stop means (24) comprising a clamp (26) removably clamped to said support means (12) and at least one thrust bearing (28) for engaging said spring (22).

12. An assembly as set forth in claim 8 further characterized by connection means (78) removably connecting said arm (14) to said cam member (30) for reversing the operative position of said arm (14).

13. An assembly as set forth in claim 8 further characterized by said cam surface (32) being symmetrical about a central position coinciding with said initial rest position for axially moving said arm (14) in response to rotation of said arm (14) about said axis in either direction from said initial rest position.

* * * * *